US005604350A

United States Patent [19]

Chu

[11] Patent Number: 5,604,350

[45] Date of Patent: Feb. 18, 1997

[54] FITTING FOR AN ION SOURCE ASSEMBLY

[75] Inventor: Chung-Hua Chu, Hsin-Chu, Taiwan

[73] Assignee: Taiwan Semiconductor Manufacturing Company Ltd., Hsin-Chu, Taiwan

[21] Appl. No.: 558,494

[22] Filed: Nov. 16, 1995

[51] Int. Cl.[6] ..... H01J 27/00

[52] U.S. Cl. ..... 250/426; 313/362.1

[58] Field of Search ..... 250/426, 423 R; 315/111.11; 313/362.1

[56] References Cited

U.S. PATENT DOCUMENTS

| | | | |
|---|---|---|---|
| 2,873,375 | 2/1959 | Dorward | 250/426 |
| 4,016,421 | 4/1977 | Hull et al. | 250/423 R |
| 4,296,330 | 10/1981 | Thomson | 250/426 |
| 4,578,589 | 3/1986 | Aithen | 250/423 R |
| 4,894,546 | 1/1990 | Fukui et al. | 250/426 |
| 5,497,006 | 3/1996 | Sferlazzo et al. | 250/427 |
| 5,523,652 | 6/1996 | Sferlazzo et al. | 315/111.41 |

OTHER PUBLICATIONS

VLSI Technology by S. M. Sze, Published by McGraw–Hill Book Co. Singapore, 1988, pp. 348–351.

*Primary Examiner*—Bruce C. Anderson

*Attorney, Agent, or Firm*—George O. Saile; William J. Stoffel

[57] ABSTRACT

An improved ion source assembly in an ion implant machine is provided that can withstand thermal stress and remain gas leak proof. The ion source assembly is comprised of a vaporizer with a tubular conduit at one end, a fitting, and an arc chamber. The improvement being leak-proof connections: (1) between the conduit and the fitting and (2) between the fitting and an arc chamber. The fitting has a chamber through the center. The chamber has a larger diameter at the back end than at the front end and a central tapered portion connecting the front end and back end portions. The conduit is fit into the back end of the chamber thereby forming a first gas leak proof connection. The fitting has an outer tapered from end portion and the arc chamber has a tapered opening. The tapered front end of the fitting engages the tapered opening of the arc chamber forming a second gas leak proof connection thereby providing a gas leak proof ion source assembly.

30 Claims, 4 Drawing Sheets

FIG. 1 – Prior Art

FITTING FOR AN ION SOURCE ASSEMBLY

BACKGROUND OF THE INVENTION

1. Field of the Invention

This invention relates to a device for an ion implant machine used in semiconductor manufacturing, and particularly to a fitting in an ion source assembly and more particularly to a fitting between a vaporizer heater and an arc chamber.

2. Description of the Prior Art

Ion implantation is an important process in semiconductor manufacturing and must be performed accurately and reliably. An ion implanter implants impurity ions into a semiconductor substrate to form doped regions, such as sources and drains. The fundamental purpose of an ion implant system is to deliver a beam of ions of a particular type and energy to the surface of a silicon substrate. FIG. 1 shows a schematic view of an ion implanter. An ion source supply 80 and an ion source power supply 82 connect to the ion source assembly 60. Following the ion path 81, on the left-hand side, a gas source 80 supplies a small quantity of source gas such as $BF_3$ into the ion source assemble 60, where the ions pass through a vaporizer oven 58, a conduit 11, and into an arc chamber 50. In the arc chamber 50, a heated filament causes the molecules to break up into charged fragments. This ion plasma contains the desired ion and many other species from other fragments and contamination. An extraction voltage, about 20 kV, moves the charged ions out of the ion source assembly 60 along the ion path 81 into the analyzer 84. The pressure in the remainder of the machine is kept below $10^{-6}$ Torr to minimize ion scattering by gas molecules. The magnetic field of the analyzer 84 is maintained such that only ion with the desired charge to mass ratio travel through without being blocked by the analyzer walls. Unblocked ions continue to the acceleration tube 86, where they are accelerated to the implantation energy as then move from high voltage to ground. The beam is well collimated by the apertures. The beam is then scanned over the surface of the wafer 90 using electrostatic deflection plates. The wafer 90 is offset slightly from the axis of the acceleration tube 86 so that ions neutralized during their travel will not be deflected on the wafer 26. A wafer handling system 88 loads/unloads wafers into an implanter wafer holder.

It is critical that the ion source assembly 60 is leak proof so that outside air does not enter the assembly or that ions do not leave. If air and contamination enter the assemble, the air and contamination disrupt the ion beam causing the ion implant to degrade which results in yield losses on wafers. In the current ion source assembly 60, the connections between the conduit 11 and the arc chamber 52 leak gas thus causing frequent chip yield losses. The connections are stressed by the constant heating and cooling cycle which cause a separations (e.g., gaps, spaces) between the conduit 11 and arc chamber 50. Moreover, yield losses, maintenance costs and down time make the gas leakage problem costly.

Therefore there is a need to develop an improved ion source assembly that is gas leak proof and that can maintain its integrity over time and many heat cycles.

SUMMARY OF THE INVENTION

It is an object of the present invention to provide an ion source assembly that is gas leak proof.

It is an object of the present invention to provide an improved ion source assembly that is gas leak proof and can withstand the stress from long term heating and cooling cycles.

It is another object of the present invention to provide an improved gas/air proof fitting between conduit and the arc chamber of a ion source assembly that can withstand the stress from long term heating and cooling cycles.

According to the present invention, an improved ion source assembly in an ion implant machine is provided. The ion source assembly is comprised of a vaporizer with a tubular conduit at one end and a fitting, and an arc chamber. The improvement of the invention being two gas leak proof connections between (1) the-conduit and the fitting and (2) between the fitting and the arc chamber. The materials and sizes of the conduit, arc chamber and especially the fitting, are detailed to ensure gas proof seals between the units.

A vaporizer oven (i.e., heater) has a tubular conduit at one end and is configured as shown in FIG. 2. Also, a fitting is made having a from end and a back end. As shown in FIG. 3, the fitting has a chamber running entirely through the center. Also, the chamber has a larger diameter at the back end portion than at the front end portion and the chamber has a central tapered portion connecting the from end and back end portions. The fitting has a tapered outside from end portion.

The conduit is fit inside the back end of the chamber thereby forming an air proof seal. ( See FIG. 3 ) An important point is that the conduit is preferably formed of stainless steel which has a higher coefficient of thermal expansion than the fitting that is preferably formed of molybdenum. Therefore, at the high operating temperature, the stainless steel conduit expands to form a tight gas proof seal with the inside wall of the fitting.

The fitting is connected to an arc chamber having a tapered opening. The tapered front end portion of the fitting engages the tapered opening in the arc chamber thereby providing a gas leak proof ion source assembly. The tapered front end of the fitting is fit into the arc chamber opening using a mechanics taper. The fitting is preferably made of molybdenum and the conduit is preferably formed is stainless steel. The arc chamber opening is preferably formed of molybdenum.

The ion implant assemble of the present invention provides a gas leak proof ion source assembly that can withstand long term thermal cycling. The conduit, which fits into the back end of the fitting, has a higher coefficient of thermal expansion than the fitting and therefore forms a tight leak proof gas seal and eliminates the leakage problems of the prior art.

BRIEF DESCRIPTION OF THE DRAWINGS

The features and advantages of the implant machine according to the present invention and further details of a process of fabricating such a machine in accordance with the present invention will be more clearly understood from the following description taken in conjunction with the accompanying drawings in which like reference numerals designate similar or corresponding elements, regions and portions and in which.

DETAILED DESCRIPTION OF THE PREFERRED EMBODIMENTS

Figure 1:
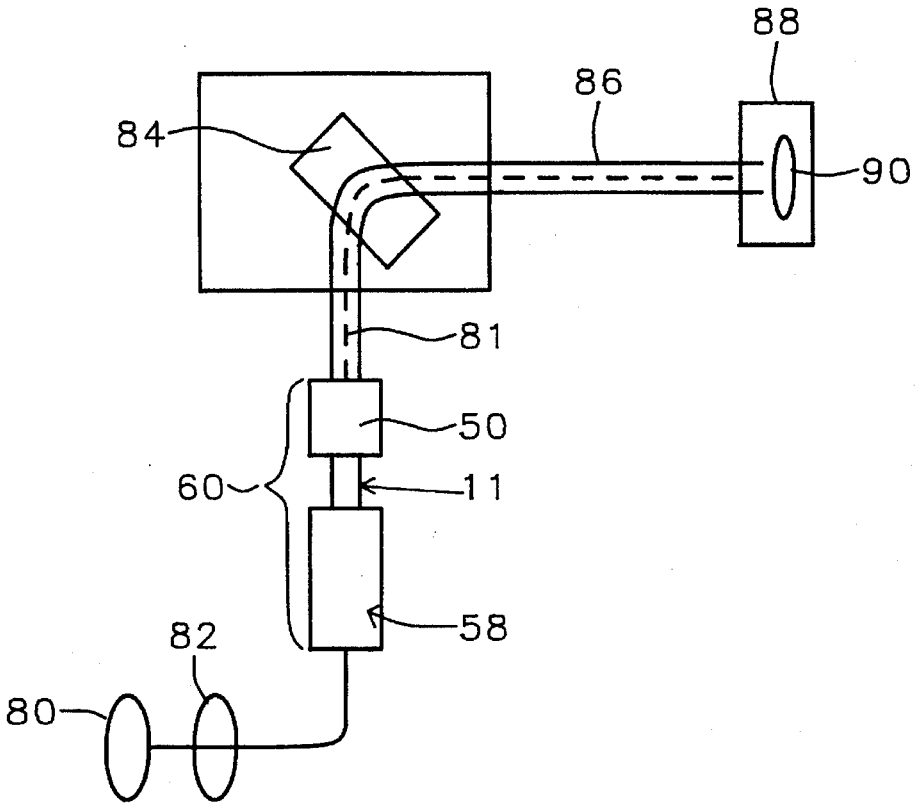
FIG. 1 shows schematic view of a conventional ion implanter machine.

The present invention will be described in detail with reference to the accompanying drawings. According to the present invention, an improved ion source assembly in an ion implant machine is provided. Referring to FIG. 1, the ion source assembly is comprised of a vaporizer heater 58 with a tubular conduit 11 at one end and a fitting 10, and an arc chamber 58. The improvement of the invention being two gas leak proof connections between: (1) the conduit 11 and the fitting 10 and (2) between the fitting and the arc chamber 58. The materials and sizes of the conduit 11, arc chamber 50 and especially the fitting 10, are detailed to ensure gas proof seals between the units.

Figure 2:
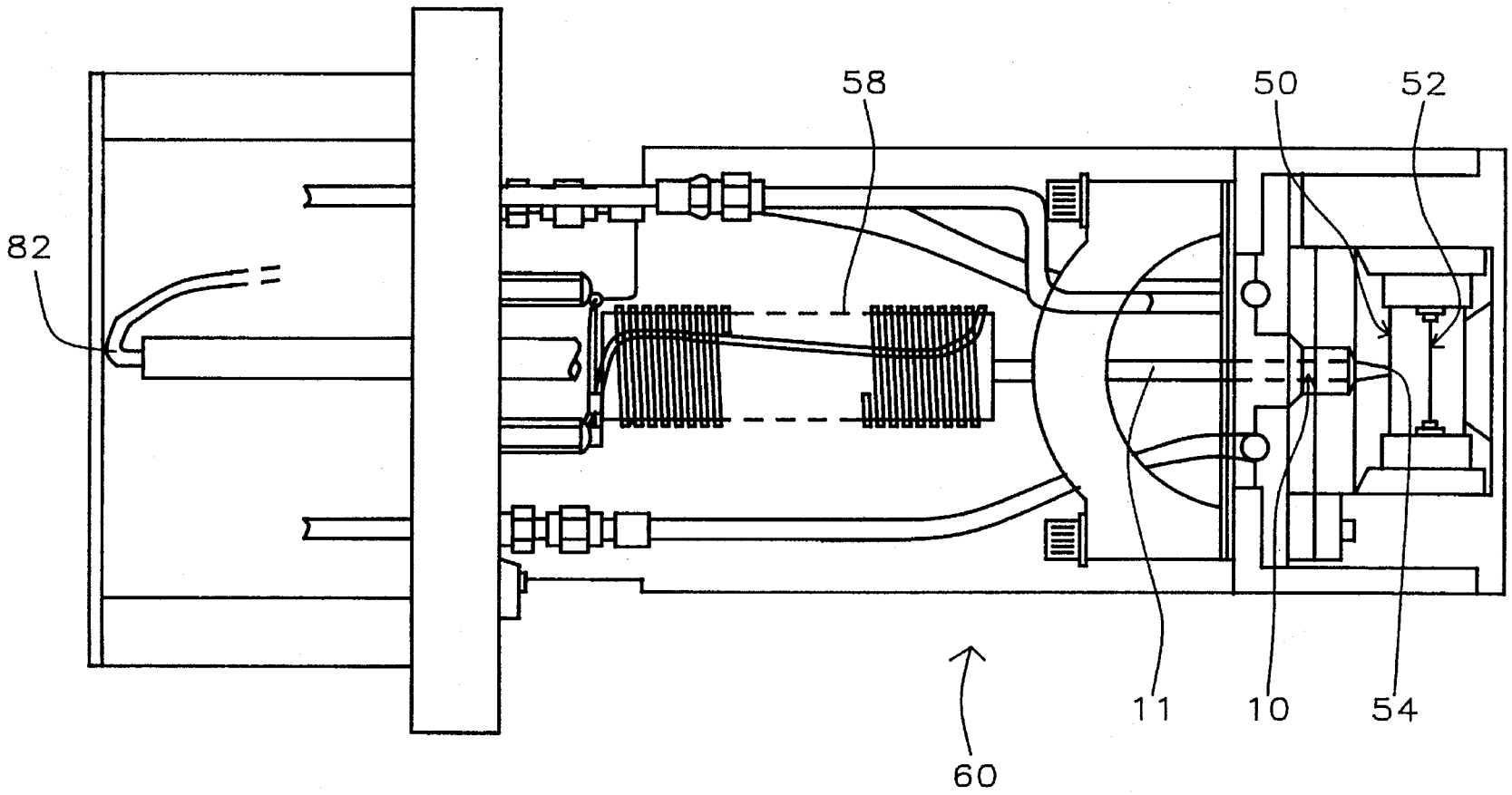
FIG. 2 is simplified view of an ion source assembly 60 of the present invention showing the vaporizer heater 58, the conduit 11, the fitting 11 and the arc chamber 50.

As shown in FIG. 2, a vaporizer heater 58 having a tubular conduit 11 at one end is provided. Tubular conduit 11 has outer diameter 12 in the range between about 6.33 mm to 6.43 mm. The conduit 11 can be formed of stainless steel, steel, molybdenum and wolfram material, and is preferably made of stainless steel material.

Figure 3:
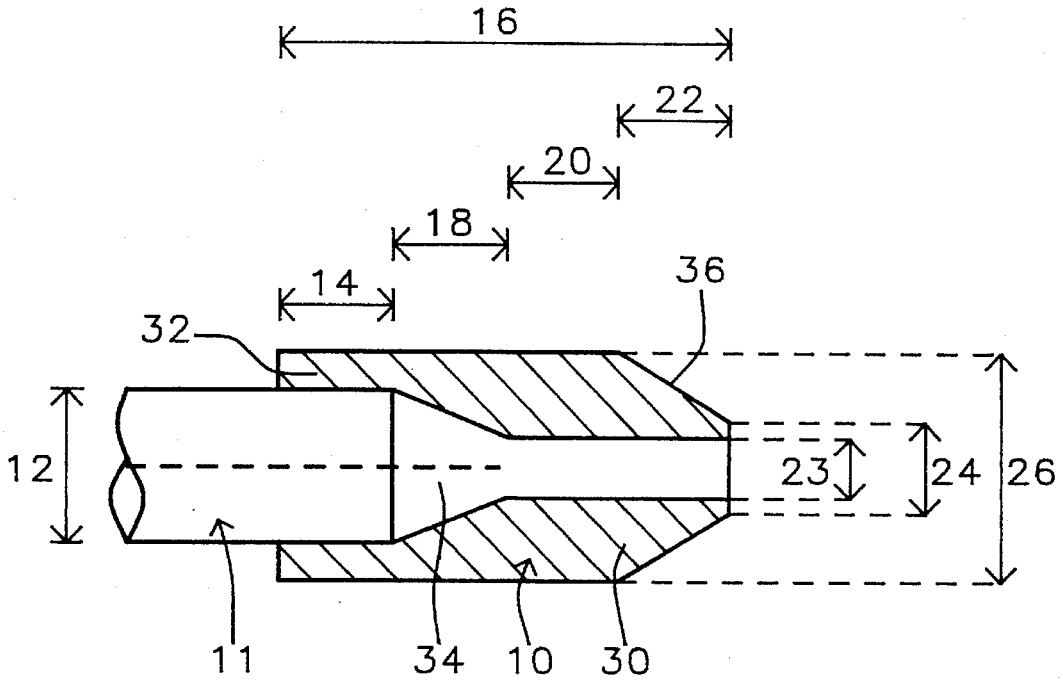
FIG. 3 is a cross-sectional view of the fitting and vapor heater conduit of the present invention.

As shown in FIG. 2 and 3, a fitting 10 is provided having a front end 30 and a back end 32. The fitting has an length 16 in the range between about 24.95 to 25.05 and more preferably about 25.00 mm. The fitting has an outer diameter 26 in the range between about 8.05 to 8.15 mm and more preferably about 8.1 mm. The fitting 10 has an external tapered from end portion 36 having a length 22 in the range between about 10.05 mm to 10.15 mm and more preferably about 10.1 mm. The from end of the fitting has an outer diameter 24 in the range between about 3.75 to 3.85 mm and more preferably about 3.8 mm. The inner diameter 23 of the from end portion of the chamber 34 can be in the range of between about 2.75 to 2.85 mm and more preferably about 2.8 mm. The fitting 10 can be formed of graphite, stainless steel, and wolfram. The fitting 10 is preferably formed of molybdenum.

The fitting 10 has a chamber 34 through the center. Also, the chamber 34 has a larger diameter 12 at the back end than at the front end 30. The chamber 34 has a central tapered portion connecting the front end 30 and back end portions 32 of the chamber. The central tapered portion of the chamber has a length 18 in the range between about 0.75 to 0.85 mm and more preferably about 0.8 mm. The chamber diameter 12 in the back end 32 is between about 6.33 to 6.43 mm and more preferably about 6.38 mm.

The conduit 11 is fit into the back end 32 of the arc chamber 34 thereby forms an air proof seal. An important point is that the conduit 11 is formed of a material that has a higher coefficient of thermal expansion than the material forming the fitting 10. The conduit 11 is preferably formed of stainless steel which has a higher coefficient of thermal expansion than the fitting 10 that is preferably formed of molybdenum. Therefore, at the high operating temperature, the stainless steel conduit 11 expands to form a tight gas proof seal with the inside wall of the fitting 10.

Figure 4A:
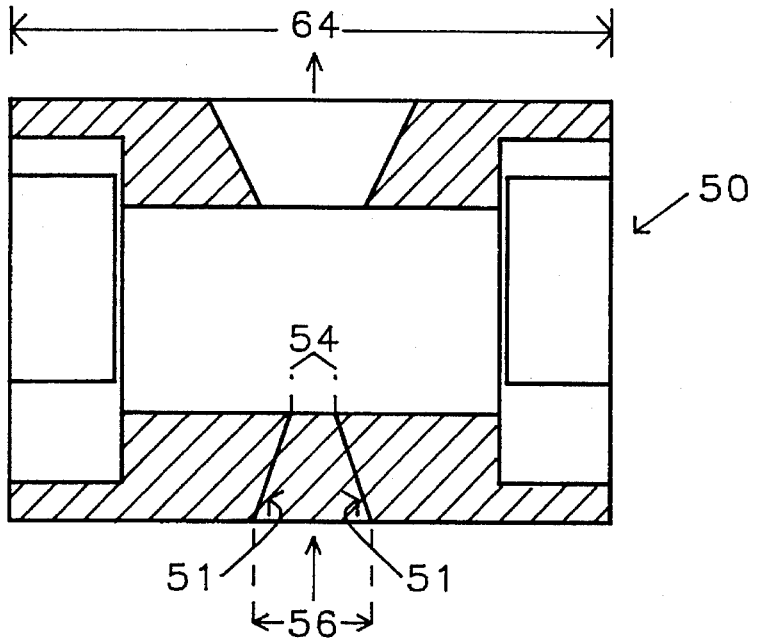
FIG. 4A is a cross sectional view of the are chamber of the present invention showing the taper opening.
Figure 4B:
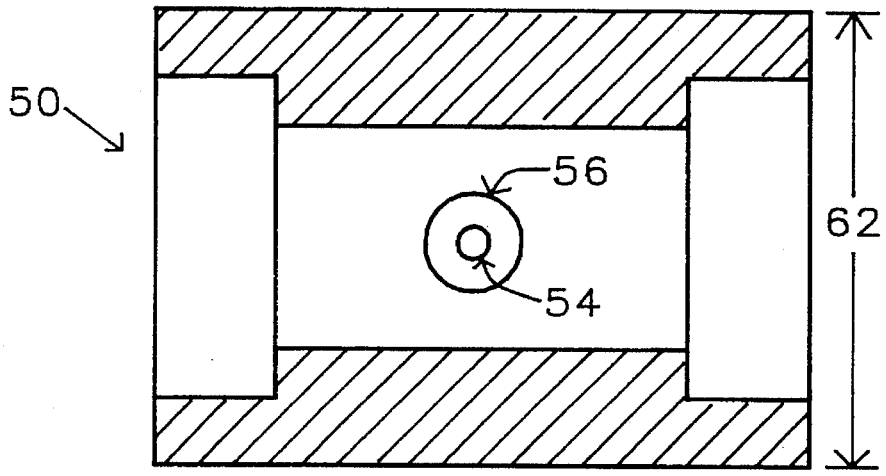
FIG. 4B is rear view of the are chamber of the present invention showing the taper opening.

Referring to FIG. 2, the fitting 10 is connected to an arc chamber 50 having a tapered opening 51. See FIG. 4A. The tapered opening 51 of the arc chamber preferably is formed of molybdenum material. The tapered opening 5 of the arc chamber has a larger outer diameter 56 in the range of between about 4.31 to 4.41 mm and more preferably about 4.36 mm. The tapered opening 51 of the are chamber has a smaller inner diameter 54 in the range of between about 1.45 to 1.55 mm and more preferably about 1.50 mm. The tapered opening 51 of the arc chamber 50 is formed of stainless steel, wolfram, and molybdenum material and is preferably formed of molybdenum material. The arc chamber can have a height 62 in the range of between about 44.05 to 45.05 mm and more preferably about 44.55 mm. See FIG. 4B. The are chamber can have a width 64 in the range of between about 50.38 to 51.38 mm and more preferably about 50.88 mm. See FIG. 4A.

The front end 30 of the fitting 10 has an outer diameter 24 in the range between about 3.75 to 3.85 mm and more preferably about 3.8 mm. The tapered from end of the fitting engages the tapered opening 51 in the arc chamber 50 thereby providing a gas leak proof ion source assembly. The fitting 10 is preferably made of molybdenum and the conduit 11 is preferably formed of stainless steel. The arc chamber opening 51 is preferably formed of molybdenum.

The ion implant assemble 60 of the present invention provides a gas/air leak proof assembly that can withstand long term thermal cycling. The fitting 10 is formed of a material having a smaller coefficient of thermal expansion (such as molybdenum ) than the conduit 11 (such as stainless steel). Therefore, at the high operating temperature, the stainless steel conduit 11 expands to form a tight gas proof seal with the inside wall of the fitting 10. Moreover, the fitting 10 makes a gas proof seal with the arc chamber opening 51 since the opening 51 is contoured to fit the front tapered nose portion 36 of the fitting 10.

While the invention has been particularly shown and described with reference to the preferred embodiments thereof, it will be understood by those skilled in the art that various changes in form and details may be made without departing from the spirit and scope of the invention.

What is claimed is:

1. An ion source assembly in an ion implant machine, with the improvement being improved connections between a conduit and a fitting and between said fitting and an arc chamber, said connections which provide a gas leak proof ion source assembly, said ion source assembly comprising:

a vaporizer oven having a tubular conduit at one end;

a fitting having a front end and a back end; said fitting having a chamber entirely through the center;

said chamber having three portions: a front end portion, a central tapered portion and a back end portion; said back end portion has a larger diameter than said front end portion; said central tapered portion connecting said front end and back end portions of said chamber;

said fitting having an outer tapered front end portion;

said conduit fits into said back end portion of said chamber thereby forming a first gas leak proof connection;

an arc chamber having a tapered opening; and said tapered front end of said fitting engages said tapered opening of said chamber forming a second gas leak proof connection thereby providing a gas leak proof ion source assembly.

2. The ion source assembly of claim 1 wherein said conduit is formed of a material that has a higher coefficient of thermal expansion than the material forming said fitting.

3. The ion source assembly of claim 1 wherein said conduit has outer diameter in the range between about 6.33 to 6.43 mm and said fitting has an outer diameter in the range between about 8.05 to 8.15 mm.

4. The ion source assembly of claim 1 wherein said fitting has an length in the range between about 24.95 to 25.05 mm.

5. The ion source assembly of claim 1 wherein said chamber diameter in said front end portion is between about 2.75 to 2.85 mm and said chamber diameter in said back end is between about 6.33 to 6.43 mm.

6. The ion source assembly of claim 1 wherein said central tapered portion of said chamber has a length in the range between about 0.75 to 0.85 mm.

7. The ion source assembly of claim 1 wherein said outside tapered nose section has a length in the range between about 10.05 to 10.15 mm.

8. The ion source assembly of claim 1 wherein said front: end portion of said fitting has an outer diameter in the range between about 3.75 to 3.85 mm.

9. The ion source assembly of claim 1 wherein said tapered opening of said arc chamber is formed of molybdenum material.

10. The ion source assembly of claim 1 wherein said fitting is formed of molybdenum.

11. The ion source assembly of claim 1 wherein said tapered opening of said arc chamber is formed of molybdenum material and the front end of said fitting has an outer diameter in the range between about 3.75 to 3.85 mm.

12. The ion source assembly of claim 1 wherein said conduit is formed of stainless steel material.

13. An ion source assembly in an ion implant machine, with the improvement being improved connections between a conduit and a fitting and between said fitting and an arc chamber, said connections which provide a gas leak proof ion source assembly, said ion source assembly comprising:

a vaporizer oven having a tubular conduit at one end; said conduit has outer diameter in the range between about 6.33 to 6.43 mm; said conduit is formed of stainless steel material;

a fitting having a front end and a back end; said fitting having a chamber entirely through the center; said fitting has an outer diameter in the range between about 8.05 to 8.15 mm.

said chamber having three portions: a front end portion, a central tapered portion and a back end portion; said back end portion has a larger diameter than said from end portion; said central tapered portion connecting said from end and back end portions of said chamber;

said fitting having an outside tapered front end portion; said fitting is formed of molybdenum;

said conduit fit into said back end portion of said chamber thereby forming a first gas proof connection;

an arc chamber having a tapered opening; said tapered opening is formed of molybdenum material; and said tapered front end of said fitting engages said tapered opening of said chamber forming a second gas leak proof connection thereby providing a gas leak proof ion source assembly.

14. The ion source assembly of claim 13 wherein said fitting has an length in the range between about 24.95 to 25.05 mm.

15. The ion source assembly of claim 13 wherein said chamber diameter in said front end is between about 2.75 to 2.85 min.

16. The ion source assembly of claim 13 wherein said central tapered portion of said chamber has a length in the range between about 0.75 to 0.85 mm.

17. The ion source assembly of claim 13 wherein said outside tapered nose section has a length in the range between about 10.05 to 10.15 mm.

18. The ion source assembly of claim 13 wherein said from end portion of said fitting has an outer diameter in the range between about 3.75 to 3.85 mm.

19. The ion source assembly of claim 13 wherein said tapered opening of said arc chamber is formed of molybdenum material.

20. The ion source assembly of claim 13 wherein said tapered opening of said arc chamber is formed of molybdenum material and the from end of said fitting has an outer diameter in the range between about 3.75 to 3.85 mm.

21. An ion source assembly in an ion implant machine, with the improvement being an improved connection between a conduit and a fitting which provides a gas leak proof ion source assembly, said ion source assembly comprising:

said fitting having a from end and a back end; said fitting having a chamber entirely through the center;

said chamber having three portions: a front end portion, a central tapered portion and a back end portion; said back end portion has a larger diameter than said front end portion; said central tapered portion connecting said front end and back end portions of said chamber;

said fitting having a tapered front end portion; said fitting is formed of molybdenum;

said conduit fit into said back end portion of said chamber thereby forming a first gas proof connection thereby providing a gas leak proof ion source assembly.

22. The method of claim 21 wherein said ion source assembly further includes a vaporizer oven having said tubular conduit at one end.

23. The method of claim 21 wherein said ion source assembly further includes an arc chamber having a tapered opening; and said tapered front end of said fitting engages said tapered opening of said are chamber forming a second gas leak proof connection thereby providing a gas leak proof ion source assembly.

24. The ion source assembly of claim 21 wherein said conduit is formed of a material that has a higher coefficient of thermal expansion than the material forming said fitting.

25. The ion source assembly of claim 21 wherein said conduit has outer diameter in the range between about 6.33 to 6.43 mm and said fitting has an outer diameter in the range between about 8.05 to 8.15 mm.

26. The ion source assembly of claim 21 wherein said fitting has an length in the range between about 24.95 to 25.05 mm.

27. The ion source assembly of claim 21 wherein said chamber diameter in said front end portion is between about 2.75 to 2.85 mm and said chamber diameter in said back end is between about 6.33 to 6.43 mm.

28. The ion source assembly of claim 21 wherein said central tapered portion of said chamber has a length in the range between about 0.75 to 0.85 mm.

29. The ion source assembly of claim 21 wherein said from end of said fitting has an outer diameter in the range between about 3.75 to 3.85 mm.

30. The ion source assembly of claim 21 wherein said fitting is formed of molybdenum and said conduit is formed of stainless steel material.

* * * * *